US006367481B1

(12) United States Patent
Nichols et al.

(10) Patent No.: US 6,367,481 B1
(45) Date of Patent: Apr. 9, 2002

(54) CIGARETTE HAVING REDUCED SIDESTREAM SMOKE

(75) Inventors: Walter A. Nichols, Chesterfield; John R. Hearn, Midlothian; F. Murphy Sprinkel, Jr., Glen Allen; Jay A Fournier, Richmond; Jerry F. Whidby, Urbanna, all of VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/498,343

(22) Filed: Feb. 4, 2000

Related U.S. Application Data

(63) Continuation of application No. 09/003,497, filed on Jan. 6, 1998, now abandoned.

(51) Int. Cl.[7] ..... A24D 1/02

(52) U.S. Cl. ..... 131/365; 131/331; 131/338; 131/341; 131/349; 131/350; 162/139

(58) Field of Search ..... 131/331, 338, 131/341, 349, 350, 365; 162/139

(56) References Cited

U.S. PATENT DOCUMENTS

| | | | |
|---|---|---|---|
| 1,770,616 | A | 7/1930 | Kean |
| 2,754,828 | A | 7/1956 | Swain |
| 3,165,105 | A | 1/1965 | Campbell |
| 3,283,762 | A | 11/1966 | Kissel |
| 3,503,406 | A | 3/1970 | Riegel et al. |
| 3,512,537 | A | 5/1970 | Pelletier |
| 3,916,914 | A | 11/1975 | Brooks et al. |
| 4,340,072 | A | 7/1982 | Bolt et al. |
| 4,526,183 | A | 7/1985 | Nichols et al. |
| 4,570,649 | A | 2/1986 | Nichols et al. |
| 4,572,217 | A | 2/1986 | Newman et al. |
| 4,646,763 | A | 3/1987 | Nichols |
| 4,649,941 | A | 3/1987 | Norman et al. |
| 4,658,838 | A | 4/1987 | Leonard |
| 4,679,574 | A | 7/1987 | Lang et al. |
| 4,691,717 | A | 9/1987 | Ikeda et al. |
| 4,699,158 | A | 10/1987 | Sprinkel |
| 4,708,151 | A | 11/1987 | Shelar |
| 4,714,082 | A | 12/1987 | Banerjee et al. |
| 4,732,168 | A | 3/1988 | Resce et al. |
| 4,756,318 | A | 7/1988 | Clearman et al. |
| 4,779,631 | A | 10/1988 | Durocher et al. |
| 4,793,365 | A | 12/1988 | Sensabaugh, Jr. et al. |
| 4,819,665 | A | 4/1989 | Roberts et al. |
| 4,827,950 | A | 5/1989 | Banerjee et al. |
| 4,848,374 | A | 7/1989 | Chard et al. |
| 4,854,331 | A | 8/1989 | Banerjee et al. |
| 4,858,630 | A | 8/1989 | Banerjee et al. |
| 4,881,556 | A | 11/1989 | Clearman et al. |

(List continued on next page.)

FOREIGN PATENT DOCUMENTS

| | | | |
|---|---|---|---|
| CA | 835684 | | 3/1970 |
| CH | 299694 | | 9/1954 |
| EP | 227424 | * | 7/1987 |
| EP | 533423 | | 3/1993 |
| FR | 1517262 | | 3/1967 |
| FR | 1546781 | | 10/1967 |

*Primary Examiner*—Michael Colaianni
(74) *Attorney, Agent, or Firm*—Burns, Doane, Swecker & Mathis, LLP

(57) ABSTRACT

A cigarette includes an ignition element in contact with tobacco, surrounded by a composite outer wrapper. The outer wrapper is impervious to oxygen causing the tobacco to extinguish between puffs. The ignition element, however, has a longer static burn time than the tobacco and remains smoldering between puffs. Upon a subsequent puff, the smoldering ignition element re-ignites the tobacco. One or more initially-occluded perforations in the outer layer maintain the uniformity in combustion of the tobacco and the ignition element.

60 Claims, 5 Drawing Sheets

U.S. PATENT DOCUMENTS 4,893,639 A 1/1990 White
4,903,714 A 2/1990 Barnes et al.
4,913,168 A 4/1990 Potter et al.
4,917,128 A 4/1990 Clearman et al.
4,928,714 A 5/1990 Shannon
4,938,236 A 7/1990 Banerjee et al.
4,938,238 A 7/1990 Barnes et al.
4,941,483 A 7/1990 Ridings et al.
4,947,875 A 8/1990 Brooks et al.
4,955,397 A 9/1990 Johnson et al.
4,955,399 A 9/1990 Potter et al.
4,967,774 A 11/1990 White
4,969,476 A 11/1990 Bale et al.
4,984,588 A 1/1991 Stewart
4,984,589 A 1/1991 Riedesser
4,989,619 A 2/1991 Clearman
4,991,596 A 2/1991 Lawrence et al.
5,016,654 A 5/1991 Bernasek et al.
5,019,122 A 5/1991 Clearman et al.
5,020,548 A 6/1991 Farrier et al.
5,027,836 A 7/1991 Shannon et al.
5,033,483 A 7/1991 Clearman et al.
5,038,802 A 8/1991 White et al.
5,042,509 A 8/1991 Banerjee et al.
5,050,622 A 9/1991 Raker et al.
5,060,666 A 10/1991 Clearman et al.
5,062,434 A 11/1991 Aulbach et al.
5,065,776 A 11/1991 Lawson et al.
5,067,499 A 11/1991 Banerjee et al.
5,072,743 A 12/1991 Perrine
5,076,292 A 12/1991 Sensabaugh et al.
5,076,297 A 12/1991 Farrier et al.
5,085,232 A 2/1992 Raker et al.
5,099,861 A 3/1992 Clearman et al.
5,105,831 A 4/1992 Banerjee et al.
5,105,835 A 4/1992 Drewett et al.
5,105,836 A 4/1992 Gentry et al.
5,105,837 A 4/1992 Barnes et al.
5,105,838 A 4/1992 White et al.
5,105,839 A 4/1992 Case et al.
5,119,834 A 6/1992 Shannon et al.
5,131,416 A 7/1992 Gentry
5,133,368 A 7/1992 Neumann et al.
5,137,034 A 8/1992 Perfetti et al.
5,150,725 A 9/1992 Cunningham et al.
5,159,940 A 11/1992 Hayward et al.
5,203,355 A 4/1993 Clearman et al.
5,211,684 A 5/1993 Shannon et al.
5,261,425 A 11/1993 Raker et al.
5,285,798 A 2/1994 Banerjee et al.
5,303,720 A 4/1994 Banerjee et al.
5,345,955 A 9/1994 Clearman et al.
5,348,027 A 9/1994 Barnes et al.
5,357,984 A 10/1994 Farrier et al.
5,360,023 A 11/1994 Blakley et al.
5,396,911 A 3/1995 Casey, III et al.
5,415,186 A 5/1995 Casey, III et al.
5,433,224 A 7/1995 Luke et al.
5,439,011 A 8/1995 Schneider
5,451,444 A 9/1995 DeLiso et al.
5,468,266 A 11/1995 Bensalem et al.
5,469,871 A 11/1995 Barnes et al.
5,482,915 A 1/1996 Golden et al.
5,538,020 A 7/1996 Farrier et al.
5,546,965 A 8/1996 White
5,551,451 A 9/1996 Riggs et al.
5,588,446 A 12/1996 Clearman
5,593,792 A 1/1997 Farrier et al.
5,598,868 A 2/1997 Jakob et al.

* cited by examiner

CIGARETTE HAVING REDUCED SIDESTREAM SMOKE

This application is a continuing application of Ser. No. 09/003,497, filed Jan. 6, 1998 now abandoned.

BACKGROUND

The present invention relates generally to a cigarette with reduced combustion of smoking material during quiescent periods between puffing. The invention also pertains to a cigarette having regulated combustion of smoking material between and during puffing.

A typical cigarette contains 750 mg to 800 mg of tobacco. Approximately 20 mg of this tobacco is burned during a puff, while approximately 50 mg is consumed between puffs. The smoke generated by the burning tobacco during a puff is termed "mainstream smoke", while the smoke generated between puffs is termed "sidestream smoke". Since a large portion of the tobacco is wasted during quiescent periods between puffs, practitioners have attempted to reduce the combustion of tobacco during these quiescent periods.

Commonly assigned U.S. Pat. No. 5,159,940 to Hayward et al. presents one technique for reducing sidestream smoke in a cigarette. As shown in FIG. 1, the cigarette 2 disclosed in this patent consists of a tubular member 4 comprised of plural sections. A first section is comprised of a heat source 10 composed substantially of carbon. The heat source 10 may also contain catalysts or burn additives to promote combustion. The heat source 10 is secured to the tubular member 4 by a retaining member 16, such as metal clips. A second section of the cigarette 2 includes a substrate 14, which comprises tobacco filler mixed with an aerosol precursor, such as glycerine or propylene glycol. A third section of the cigarette 2 comprises an expansion chamber 8. A fourth section comprises a mouthpiece filter 6, such as a cellulose acetate filter.

The above-described cigarette functions in the following manner. A user ignites the heat source 10, upon which the carbonaceous material begins to burn and generate heat. The heat generated by the heat source 10 vaporizes the aerosol precursor in substrate 14 and gases are generated containing flavor extracted from the tobacco in the substrate 14. The gases are drawn into the expansion chamber 8, where the gases expand and cool to form an aerosol 12. The aerosol 12 is drawn out through the filter 6 for delivery to the user. This cigarette thus operates by generating a flavored aerosol rather than burning the tobacco product in a conventional manner. As such, this cigarette generates little or no sidestream smoke while being consumed.

Another cigarette having reduced sidestream smoke is disclosed by U.S. Pat. No. 5,105,835 to Drewett et al. The cigarette disclosed therein also uses a heat source composed of a carbonaceous material. The heat source in this device is inserted within a plug of tobacco and is in contact with the tobacco. A wrapper of low permeability surrounds the plug of tobacco to restrict the amount of oxygen which passes through the wrapper to the underlying tobacco and heat source, thus preventing free smoulder of the tobacco.

The above-described cigarette functions in the following manner. The consumer lights the heat source and the smoking material. During a puff, both the heat source and the smoking material burn to deliver flavor to the consumer. When the user stops puffing, however, insufficient oxygen reaches the tobacco material to sustain its combustion. The tobacco, therefore, stops burning during such quiescent periods. The carbonaceous heat source, on the other hand, has sufficient thermal energy to remain burning. When the user takes another puff on the cigarette, increased oxygen is fed to the heat source, which increases its rate of combustion and the amount of heat generated thereby. This increased heat re-ignites the tobacco. Thus, this device reduces sidestream smoke between puffs and also delivers flavor in a conventional manner by burning tobacco.

The use of relatively thick and/or low permeability wrappers or shells in both of the above-described cigarettes generally reduces the influx of oxygen to the interior of the cigarettes. Thus, in the exemplary case of Drewett, despite the use of small perforations in the outer wrapper, this cigarette may non-uniformly burn the tobacco from puff to puff depending on the strength of the puff and other variables.

Accordingly, it is an exemplary object of the present invention to provide a cigarette having reduced sidestream smoke which has more uniform and controllable combustion characteristics.

SUMMARY

This and other exemplary objectives are achieved according to the present invention through a cigarette including an ignition element disposed within a plug of tobacco, which, in turn, is disposed within one or more layers of cigarette paper. A perforated wrapper is then wrapped around the cigarette paper layer(s), such that the inner cigarette paper initially blocks the perforations in the outer wrapper and thereby prevents oxygen from reaching the interior of the cigarette. Other materials can be used to block the perforations besides the paper layer(s), such as waxes or films.

In a preferred embodiment, the perforated outer wrapper has a permeability selected to provide enough oxygen to the ignition element to sustain its combustion in quiescent periods between puffs, but to provide insufficient oxygen to sustain combustion in the tobacco between puffs. Thus, the tobacco is extinguished (or subject to a reduced rate of combustion) between puffs, thereby eliminating or greatly reducing the amount of sidestream smoke generated by the cigarette. When a user takes a puff on the cigarette after a quiescent period, oxygen is fed to the ignition element, which increases its rate of combustion and temperature. This, in turn, re-ignites the tobacco. To perform in this manner, an ignition element is selected which possesses different thermal characteristics in a low oxygen environment compared to the tobacco. Generally, an ignition element is selected which is less readily extinguished in a low oxygen environment compared to the tobacco. In one exemplary embodiment, the ignition element comprises a carbon element inserted in the plug of tobacco.

During use of the cigarette, the heat generated by the ignition element and tobacco undergoing combustion burns away the paper blocking the perforations, thereby exposing the perforations and creating passageways which allow oxygen to reach the interior of the cigarette through the outer wrapper. The perforations are "opened" in successive fashion as the ember of the ignition element advances inward from the distal end of the cigarette. That is, perforations located at the distal end of the cigarette are opened first, followed by perforations located successively further inward from the distal end. In this manner, oxygen is made available to the ignition element even when the burning portion of the ignition element is recessed within the outer wrapper. Initially, however, perforations located inward from the distal end are closed, such that air will not be drawn undesirably through the base of the cigarette. Accordingly, the cigarette of the present invention reduces sidestream smoke while providing uniform and controllable combustion characteristics.

BRIEF DESCRIPTION OF THE DRAWINGS

The foregoing, and other, objects, features and advantages of the present invention will be more readily understood upon reading the following detailed description in conjunction with the drawings in which:

FIG. 2(*b*) shows a cross-section of the cigarette of FIG. 2(*a*);

FIG. 3(*b*) shows a cross-section of the cigarette of FIG. 3(*a*);

FIG. 5(*b*) shows an exemplary layout of perforations in the composite outer wrapper according to a second embodiment; and FIG. 5(*c*) shows an exemplary layout of perforations in the composite outer wrapper according to a third embodiment.

DETAILED DESCRIPTION

In the following description, for purposes of explanation and not limitation, specific details are set forth in order to provide a thorough understanding of the invention. However, it will be apparent to one skilled in the art that the present invention can be practiced in other embodiments that depart from these specific details. In other instances, detailed descriptions of well-known methods and devices are omitted so as not to obscure the description of the present invention with unnecessary detail. In the figures, like numbers designate like parts.

Figure 1:
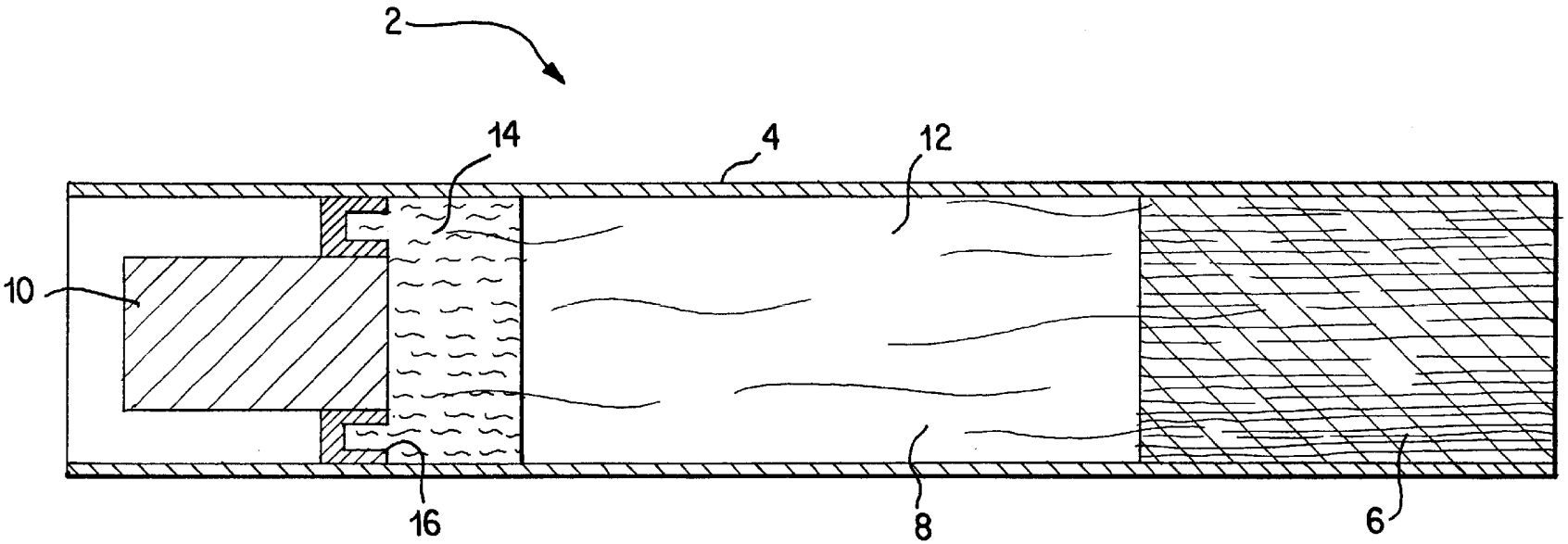
FIG. 1 PRIOR ART
FIG. 1 shows a device for generating a flavored aerosol according to the prior art.
Figure 2A:
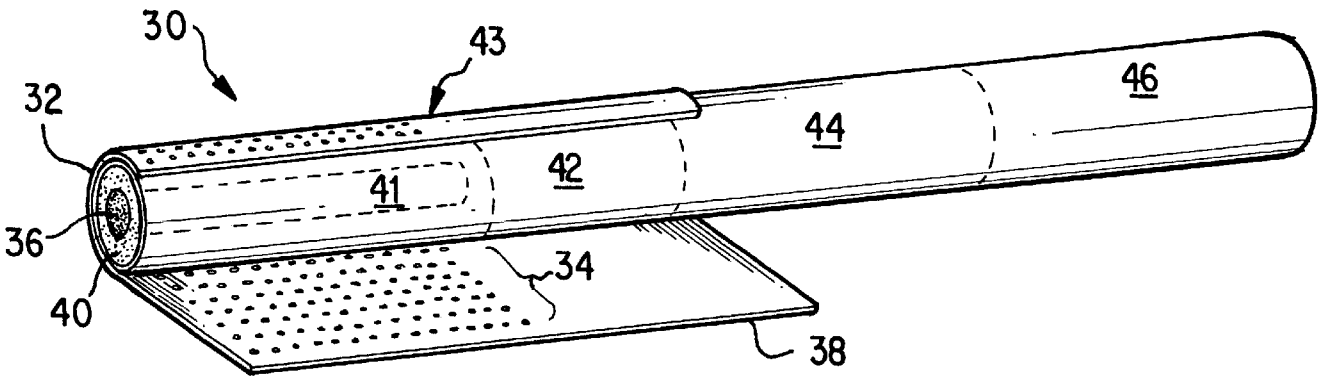
FIG. 2(*a*) shows a first embodiment of a cigarette according to the present invention.
Figure 2B:
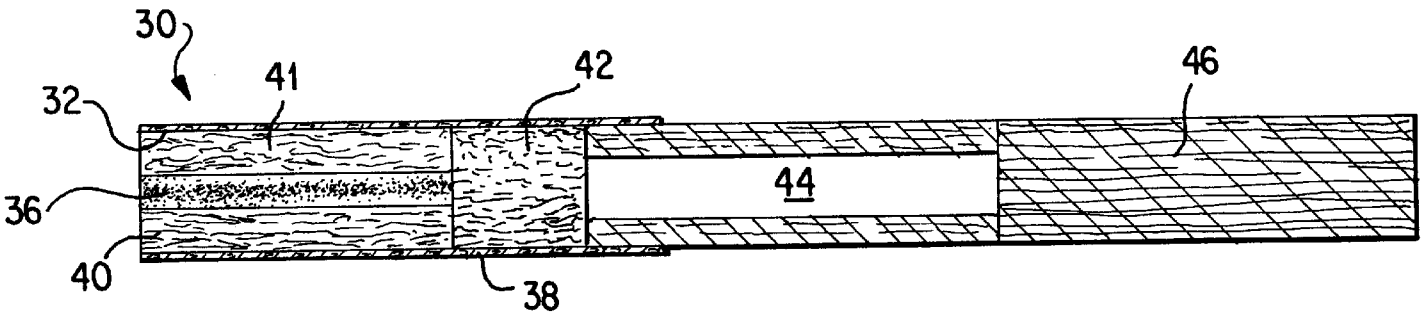

FIG. 2(*a*) shows a perspective view of a cigarette 30 according to a first embodiment of the present invention, and FIG. 2(*b*) shows a cross-section view of this cigarette 30. According to exemplary embodiments, the cigarette 30 is approximately 83 mm long and contains four main sections. A first section 41 includes tobacco 40 (or a tobacco-based material) and an ignition element 36 in contact with the tobacco 40. This section joins a second section 42, which contains only tobacco. The next section 44 comprises a hollow tube, such as a cellulose acetate fiber tube. Finally, section 44 joins a filter section 46, which can comprise a conventional filter section (e.g., comprising a cellulose acetate filter). According to exemplary embodiments, the first section 41 is approximately 21 mm in length, the second section 42 is approximately 10mm in length, the third section 44 is approximately 22 mm in length, and the last section 46 is approximately 30 mm in length.

Carbon or carbon-based compounds are generally suitable materials for use in forming the ignition element 36. Salts, such as the carbonates and/or acetates of potassium and/or sodium, can be used to modify the onset combustion temperatures of the carbon-based ignition element 36. More generally, any material or compound can be used for forming the ignition element 36 providing that this element is less readily extinguished in a low oxygen environment compared to the tobacco 40. This may equate to the ignition element 36 having a longer "static burn time" compared to the tobacco 40 in a low oxygen environment. In another embodiment, for example, the ignition element 36 can comprise a plug of tobacco having a longer static burn time than the surrounding tobacco material 40. This can be achieved by treating the tobacco materials with various combustion retardants and/or promoters to achieve a desired burn rate ratio between an inner and outer tobacco sections.

With reference to both FIGS. 2(*a*) and 2(*b*), the ignition element 36 according to the first exemplary embodiment comprises a cylindrical rod which spans the length of the first section 41 (e.g., approximately 21 mm). The ignition element 36 is approximately 50 mg in weight and has a diameter of approximately 3 mm. The axis of the ignition element 36 coincides with the axis of the cigarette 30. However, those skilled in the art will appreciate that the ignition element 36 can be formed in different shapes. For instance, the ignition element 36 can comprise a plurality of smaller rods located within the first section 41, or can comprise one or more strips of material located within the first section 41.

One or more layers of cigarette paper (denoted generally as paper 32) cover the various sections containing tobacco 40. The cigarette paper 32 can comprise any conventional cigarette paper, or can comprise low sidestream cigarette paper such as a high basis weight paper containing calcium carbonate (e.g., at approximately 53 g/m$^2$). As those skilled in the art will appreciate, various other layers of paper and matings can be used to cover the various sections 41, 42, 44, and 46.

Figure 3A:
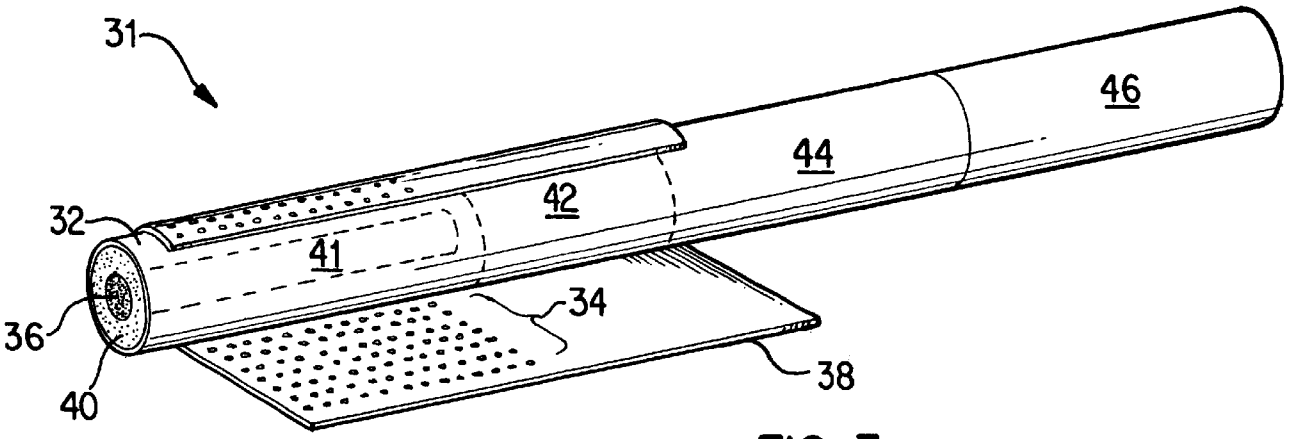
FIG. 3(*a*) shows a second embodiment of a cigarette according to the present invention.
Figure 3B:
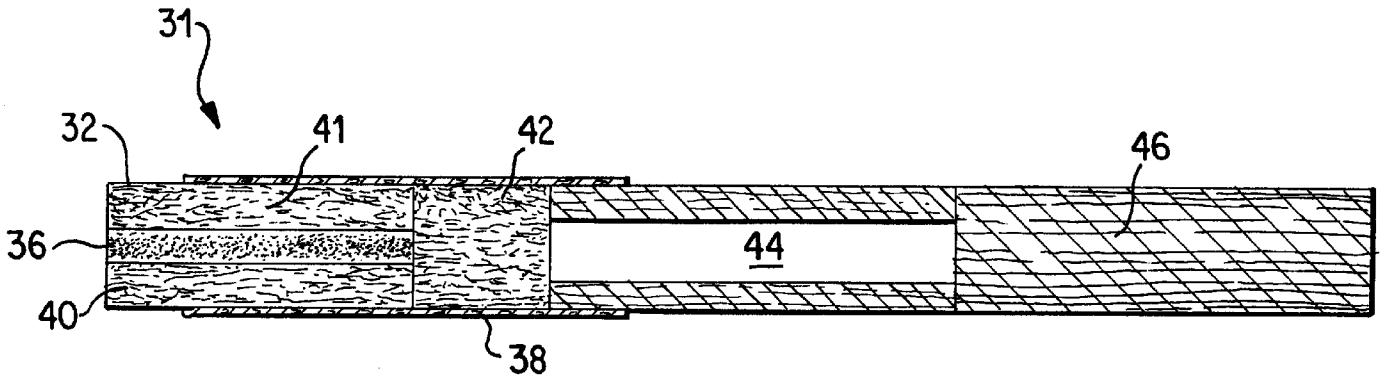

A composite outer wrapper 38 is then wrapped around the inner cigarette paper 32. As shown in FIGS. 2(*a*) and 2(*b*), the composite outer wrapper 38 preferably covers the tobacco in sections 41 and 42. More specifically, the composite outer wrapper 38 in this embodiment runs from the exposed distal tip of section 41 to a few millimeters beyond the end of section 42. In the cigarette 31 shown in FIGS. 3(*a*) and 3(*b*), however, the composite outer wrapper 38 starts approximately 1 mm to 5 mm from the exposed tip of section 41. Leaving a section of the tip exposed allows oxygen to more readily permeate the tip of the cigarette. This makes it easier to initially light the cigarette. It should be noted that FIGS. 2(*a*) and 3(*a*) show the composite outer rapper 38 partially removed from the cigarette (30, 31) to better illustrate the composite outer wrapper 38. During use, however, the composite outer wrapper 38 is wrapped entirely around the cigarette (30, 31).

Figure 4:
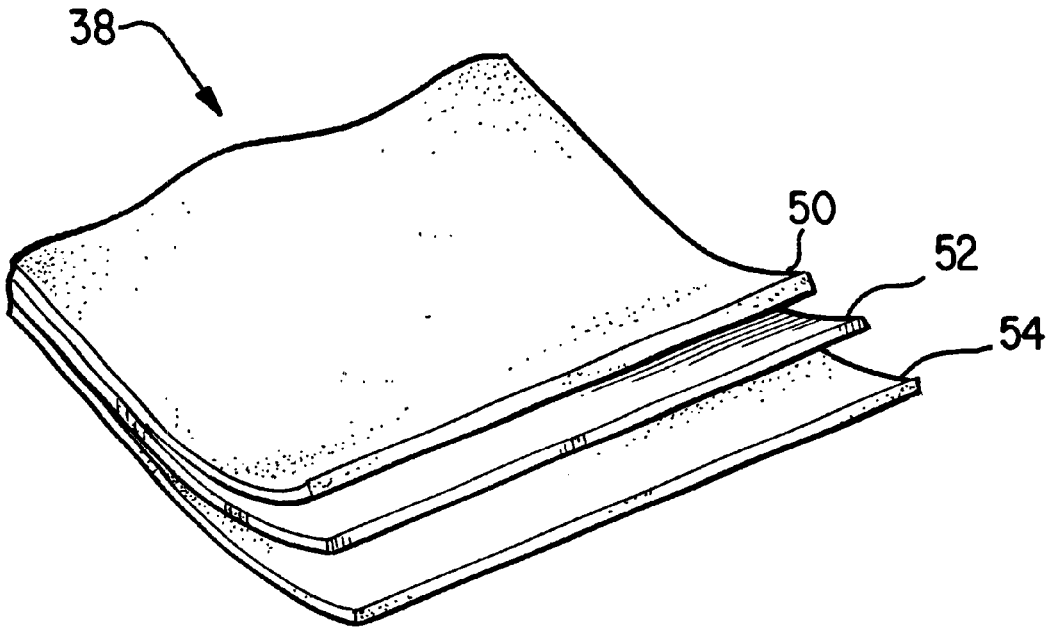
FIG. 4 shows an exemplary construction of a composite outer wrapper for use in the cigarettes of the present invention.

As shown in FIG. 4, in the preferred embodiment, the composite outer wrapper 38 comprises a three-ply material formed from a layer 52 of metal foil interposed between two layers (50, 54) of low sidestream paper (such as paper containing a calcium carbonate filler at approximately 53 g/m$^2$), or other type of paper. According to preferred embodiments, the metal foil is formed from a sheet of aluminum foil having a thickness of approximately 0.00025 to 0.002 inches, although thinner or thicker foils can be used. The three layers can be laminated together with a suitable adhesive, such as polyvinyl acetate adhesive.

The metal foil 52 serves three principal purposes. First, the foil 52 is substantially impervious to oxygen. Thus, the foil 52 creates a low oxygen environment within the cigarette between puffs by blocking the flow of oxygen into the cigarette through the side walls of the cigarette. Second, the foil removes and dissipates heat from the ignition element 36 and the tobacco 40. This promotes the quick reduction in combustion rate of the tobacco 40 after a puff. Third, the foil 52 shields the outer paper layer 50 from the ignition element 36, and helps to reduce the charring of the outer paper layer 50 caused by the heat generated by the ignition element 36. The reduction in charring is proportional to the thickness of the foil 52. Relatively thick foils 52 will produce minimal charring of the paper layer 50. This results in minimal discoloring of the paper layer 50. Thinner layers may produce some discoloration (i.e. tanning or blackening) of the paper layer 50. The degree of charring is also directly proportional to the number of perforations in the wrapper (to be discussed in greater detail below).

In other embodiments, instead of a three-ply wrapper, an outer laminated wrapper comprising a single layer of paper and a single layer of foil can be used, or just a single layer of foil or other material can be used. Furthermore, other materials can be used to form the outer wrapper besides metal foil, such as ceramic-based layers or other substantially non-combustive materials.

With reference again to FIGS. 2(*a*) and 3(*a*), the composite outer wrapper 38 preferably includes a number of perforations 34. In the exemplary embodiments shown in these figures, the perforations 34 comprise a plurality of small apertures. These perforations 34 provide passageways into the interior of the cigarette to allow a limited amount of oxygen to reach the underlying tobacco 40 and ignition source 36 through the sides of the cigarette. However, the cigarette paper 32 lies between the wrapper 38 and the tobacco 40, and therefore initially blocks the passageways. After a series of puffs, the heat generated by the ignition element 36 and the tobacco 40 burns the cigarette paper 32 beneath the perforations 34, thereby opening up the passageways. More specifically, the perforations 34 are "opened" in successive fashion as the ember of the ignition element and the portion of the tobacco bed undergoing combustion advances from the distal end of the cigarette toward the mouthpiece end of the cigarette. That is, perforations located at the distal end of the cigarette are opened first, successively followed by perforations located further inward from the distal end. In this manner, oxygen is made available to the ignition element even when the combustive portion of the ignition element is recessed within the outer wrapper. Initially, however, perforations located inward from the distal end of the cigarette are closed, such that air will not be drawn undesirably though the base of the cigarette. Accordingly, the cigarette of the present invention reduces sidestream smoke while providing uniform combustion characteristics.

The size and position of the perforations 34 can be selected to achieve different burn rates. Generally, the influx of oxygen can be evenly distributed to provide a uniform burn rate by using many relatively small perforations, or by using a plurality of tiers of small perforations having different dimensions. For instance, a plurality of evenly dispersed square perforations having dimensions of approximately 0.5 mm by 0.5 mm can be used. In one exemplary embodiment, the perforations begin approximately 1 mm from the left-most edge of the wrapper 38 (with reference to the graphical depictions of FIGS. 2(*a*) and 3(*a*)) and end approximately 7 mm to 15 mm from the left-most edge of the wrapper 38. The ignition element 36 preferably extends at least a short distance beyond the end of the perforations 34.

The perforations 34 are shown as having a substantially square shape, but other shapes can be used. The perforations 34 can have circular or oval shapes, slot-like shapes, or other shapes, or different shapes can be used on the same wrapper at different regions. Furthermore, the perforations 34 are illustrated as forming orderly rows, but the perforations can be dispersed over the surface of the composite outer wrapper 38 in other patterns, or randomly dispersed over the surface.

Figure 5A:
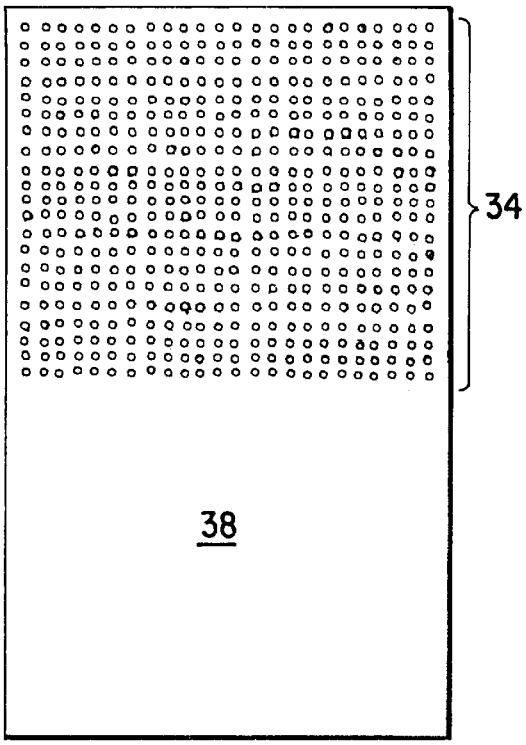
FIG. 5(*a*) shows an exemplary layout of perforations in the composite outer wrapper according to a first embodiment.
Figure 5B:
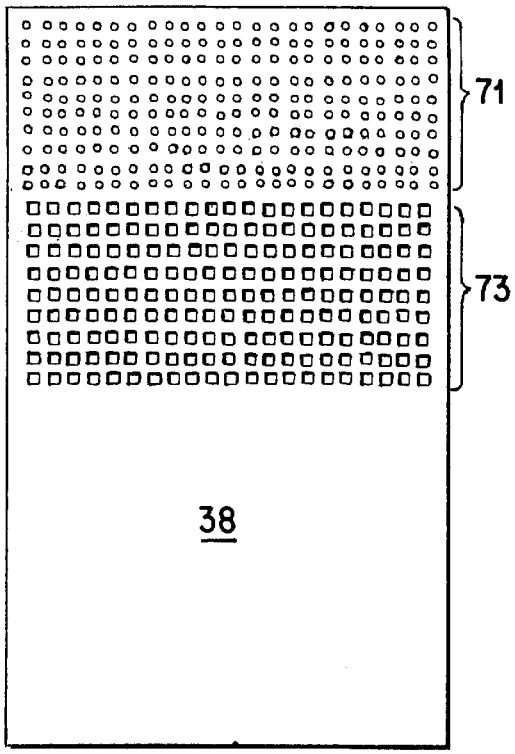
Figure 5C:
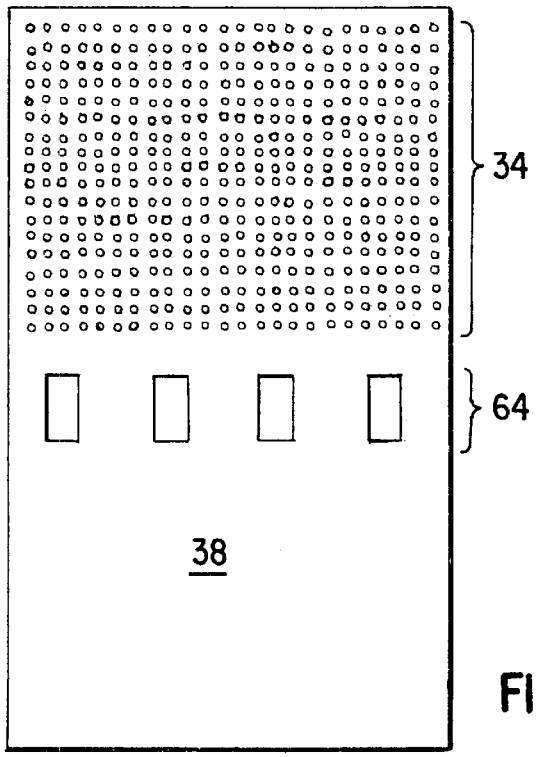

FIG. 5(*a*) illustrates the wrapper 38 of FIGS. 2(*a*), 2(*b*), 3(*a*) and 3(*b*) including a plurality of perforations 34. In one exemplary embodiment, the perforations begin approximately 1 mm from the "top" or distal end of the wrapper 38 and end approximately 7 mm to 15 mm from the top of the wrapper 38. These perforations can have any desired dimensions as mentioned above. For instance, square perforations having dimensions of 0.5 mm by 0.5 mm can be used, where each perforation is separated from its neighboring perforation by 0.5 mm. These dimensions are exemplary, however, and those skilled in the art will appreciate that other dimensions may be appropriate.

FIG. 5(*b*) shows another embodiment which includes different tiers of small perforations having different dimensions. As shown there, the perforations 71 comprising a first section of perforations have smaller openings ("sizes") than the perforations 73 comprising a second section of perforations. For instance, the perforations 71 can comprise square openings having dimensions of 0.5 mm by 0.5 mm, while the perforations 73 can comprise square openings having dimensions of 1.0 mm by 1.0 mm. These larger perforations 73 deliver more oxygen to those portions of section 41 which are remote from the exposed tip of the cigarette. These larger perforations 73 may be desirable to enhance the delivery of oxygen to more recessed portions of the ignition element 36. The portions of the section 41 located closer to exposed tip of the cigarette receive more oxygen from the exposed tip, and therefore smaller perforations 71 will suffice in these portions. Only two gradations of perforations (71, 73) have been shown. However, those skilled in the art will appreciate that three or more different sized perforations can be used.

FIG. 5(*c*) shows another embodiment of the composite outer wrapper 38 having a different arrangement of perforations formed thereon. More specifically, the composite outer wrapper 38 includes the same array of perforations 34 shown in FIG. 5(*a*). Additionally, the composite outer wrapper 38 also includes a series of larger perforations 64 further back from the tip of the cigarette. These larger perforations 64 are located approximately 15 mm from the tip of the cigarette. With reference to FIG. 2(*a*), these larger perforations 64 are located approximately at position 43 denoted as "x". A supplemental film or wax (or other material) may cover these perforations 64.

As mentioned above, when the outer wrapper 38 is wrapped around the inner cigarette paper, the perforations in the outer wrapper are occluded by the inner paper. This initially prevents oxygen from reaching the interior of the cigarette through the perforations. During use, the ignition element and the tobacco material around it reach sufficient thermal energy to burn the paper from beneath the perforations. Typically, the perforations located closest to the burning end of the ignition element and surrounding tobacco (i.e., the portion of the cigarette with the greatest thermal energy) will open first. Thus, the perforations located at the distal end of the wrapper will typically open first, followed by successively more inward perforations as the burning coal of the ignition element advances into the interior of the wrapper.

However, it should be noted that perforations need not be opened in the above-described sequence. Namely, perforations which are axially displaced from the ember may be opened. For instance, if the ignition element and the surrounding tobacco acquire sufficient thermal energy, the larger perforations 64 shown in FIG. 5(*c*) can open, even though the ember may be located toward the distal end of the cigarette. Upon the opening of these larger perforations 64, air is drawn into the cigarette from the base of the cigarette. During a draw, therefore, some air will flow through the cigarette behind the plug of partially burned tobacco. This will decrease the flow of oxygen axially passing through the cigarette and the burning ignition element. This has the end result of extinguishing the cigarette. Alternatively, smaller perforations 64 can be used which will serve to reduce the rate of combustion in the cigarette, rather than entirely extinguish the cigarette.

The occluding cigarette paper 32 has been discussed above as blocking the perforations from the underside of the outer layer 38. However, the cigarette paper 32 which blocks the perforations can be located on top of the outer wrapper 38. Alternatively, the perforations in the outer layer 38 can be blocked from both the inner and outer surfaces of the outer layer 38.

Finally, instead of cigarette paper 32, or supplemental to the cigarette paper 32, occlusions can be formed blocking the perforations in the outer wrapper layer by filling in the perforations with some material which burns or melts when exposed to thermal energy from the ignition element. For example, a cellulosic or wax-like material can be formed in the perforations.

Having discussed the structural components of the cigarette, the operational characteristics of this device will now be discussed in greater detail.

In use, a consumer lights the end of the cigarette (30, 31) with a lighter or other suitable device while preferably simultaneously puffing on the cigarette. At this point, the portions of the cigarette paper 32 beneath the perforations 34 are intact, and therefore the air drawn into the cigarette originates primarily from the exposed open end of the cigarette. This makes it easy to light the ignition source 36 and the tobacco 40.

After the consumer's initial puff, the tobacco may continue to burn unassisted for a short time due to the close proximity of the open end of the cigarette and the availability of oxygen from the open end. In this regard, the cigarette 31 shown in FIGS. 3(*a*) and 3(*b*) will burn longer unassisted than the cigarette 30 shown in FIGS. 2(*a*) and 2(*b*) due to the length of exposed cigarette paper 32 near the tip.

The availability of oxygen decreases, however, as the coal of the ignition element advances down the cigarette beneath the composite outer wrapper 38, which is substantially impervious to oxygen and other gases. This lack of oxygen will reduce and eventually extinguish the combustion in the tobacco 40. This is accelerated by the use of the aluminum foil 52 (of FIG. 4), which draws thermal energy quickly away from the tobacco 40. However, the carbon-based composition of the ignition element 36 allows the ignition element 36 to remain burning during quiescent periods between puffs. Alternatively, the carbon-based material may not actually burn during the quiescent periods, but may simply retain sufficient thermal energy to re-ignite the tobacco 40 when the consumer takes another puff on the cigarette. This can be satisfied by selecting the composition, mass and dimensions of the ignition element 36 such that its temperature does not drop below its re-ignition temperature (i.e., approximately 250°–300° C. in one exemplary embodiment). For frame of reference, the ignition element 36 can rise to temperatures between approximately 700° C. to 900° C. during a puff in one exemplary embodiment.

When the user does take another draw on the cigarette, air axially flows through the cigarette, supplying oxygen to the ignition element 36 and the tobacco 40. This influx of oxygen increases the combustion rate of the ignition element 36, which, in turn, re-ignites the tobacco 40. When the user finishes his or her puff, the tobacco 40 again is extinguished.

During the first few initial puffs, the ignition element 36 generates sufficient heat to burn out the cigarette paper 32 which lies beneath at least the distal-most section of the perforations 34 in the composite outer wrapper 38. These opened passageways supply additional oxygen to the ignition element 36 between puffs and during puffs, and thereby allow the ignition element 36 to remain lit as the coal advances further into the interior of the cigarette.

If the ignition element acquires sufficient thermal energy, perforations located axially displaced from the ember may be opened. For instance, if the ignition element acquires sufficient thermal energy, the larger perforations 64 shown in FIG. 5(*c*) can open, even though the ember of the ignition element may be located near the distal end of the cigarette. Upon the opening of these larger perforations 64, air is drawn into the cigarette from the base portion of section 41 of the cigarette. During a draw, therefore, some air will flow through the cigarette behind the plug of partially burned tobacco. This will decrease the flow of oxygen axially passing through the cigarette and the burning ignition element 36. This has the end result of extinguishing the cigarette for relatively large perforations 64. The larger perforations 64 can also be opened when the ember of the ignition element 36 advances close enough to the larger perforations 64 to burn the paper 32 disposed beneath these perforations.

Because the tobacco 40 is extinguished between puffs, very little tobacco 40 is wasted. In one embodiment, 250 mg of tobacco can be used to provide eight or nine puffs, whereas a conventional cigarette requires 700 to 800 mg of tobacco to provide the same number of puffs.

Furthermore, the use of an array of perforations on the composite outer wrapper 38 provides uniform combustion of the underlying ignition element 36 and tobacco 40. Larger perforations 64 near the rear of the section 41 open when the ignition element acquires sufficient thermal energy to provide further flow rate control.

If desired, the cigarette wrapper according to the invention can be used with a cigarette wherein the ignition element 36 is omitted. The wrapper can incorporate features discussed above in connection with FIGS. 3(*a*), 4 and 5(*a–c*).

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be the scope and spirit of the present invention as defined by the following claims. For instance, although the above-discussion has been framed in the context of cigarettes, the invention extends to any smoking article. Furthermore, the section 41 of smoking material is not limited to tobacco, but can comprise any substrate containing flavor released upon combustion.

What is claimed is:

1. A smoking article having reduced sidestream smoke between puffs, comprising:

a smoking material;

an ignition element within and in contact with said smoking material, said smoking material being more readily extinguishable in a low oxygen environment compared to said ignition element;

a first wrapper formed around said smoking material and said ignition element; and a second wrapper formed around said first wrapper, wherein said second wrapper reduces combustion of said smoking material between puffs, wherein said first wrapper is more combustible than said second wrapper when exposed to thermal energy generated by said ignition element and smoking material.

2. The smoking article of claim 1, wherein said smoking material comprises a tobacco-based material.

3. The smoking article of claim 1, wherein said ignition element comprises a carbon-based material.

4. The smoking article of claim 1, wherein said ignition element has a substantially cylindrical shape.

5. The smoking article of claim 1, wherein said second wrapper comprises a composite layer.

6. The smoking article of claim 5, wherein said composite layer includes a metal foil layer.

7. The smoking article of claim 6, wherein said composite layer includes a paper layer laminated to said metal foil layer.

8. The smoking article of claim 6, wherein said composite layer includes two paper layers laminated on either side of said metal foil layer.

9. The smoking article of claim 1, wherein said second wrapper extends to a distal end of said smoking material.

10. The smoking article of claim 1, wherein an end of said second wrapper is spaced from a distal end of said smoking material.

11. The smoking article of claim 10, wherein said end of said second wrapper is spaced approximately 1 mm to 5 mm from said distal end.

12. The smoking article of claim 1, further including at least one perforation in said second wrapper.

13. The smoking article of claim 12, wherein said at least one perforation comprises at least one perforation of a first size and at least one perforation of a second size which is larger than said first size.

14. The smoking article of claim 13, wherein said at least one perforation of said first size is located closer to a distal end of said smoking article than said at least one perforation of said second size.

15. The smoking article of claim 12, wherein said at least one perforation is a thermally opened perforation, said perforation being blocked by an occlusion which blocks a flow of oxygen through said perforation until sufficient thermal energy by combustion of said smoking material and said ignition element opens said perforation.

16. The smoking article of claim 15, wherein said occlusion comprises said first wrapper.

17. The smoking article of claim 12, wherein said at least one perforation comprises a plurality of perforations arranged in a pattern.

18. A smoking article having reduced sidestream smoke between puffs, comprising:

a smoking material;

an ignition element within and in contact with said smoking material, said smoking material being more readily extinguishable in a low oxygen environment compared to said ignition element;

a wrapper around said smoking material and said ignition element, said wrapper reducing combustion of said smoking material between puffs, and said wrapper including at least one thermally opened perforation, said perforation being blocked by an occlusion which blocks flow of oxygen through said perforation until sufficient thermal energy by combustion of said smoking material and said ignition element opens said perforation.

19. The smoking article of claim 18, wherein said occlusion comprises a first layer beneath or above said wrapper.

20. The smoking article of claim 18, wherein said occlusion comprises a combustible filling material.

21. The smoking article of claim 18, wherein said at least one perforation comprises a plurality of perforations.

22. The smoking article of claim 21, wherein said plurality of perforations comprises a first plurality of perforations having openings having a first dimension and a second plurality of perforations having openings having a second dimension, wherein said openings with said first dimension are smaller than said openings with said second dimension.

23. The smoking article of claim 22, wherein said first plurality of perforations are located closer to a distal end of said cigarette than said second plurality of perforations.

24. The smoking article of claim 18, wherein said smoking material is disposed in a smoking material section of said smoking article having a base end and an open distal end, and said at least one perforation is located near said base end.

25. The smoking article of claim 24, wherein said at least one perforation includes spaced apart perforations located closer to the open distal end than said at least one perforation which is located near the base end, said spaced apart perforations having smaller sizes compared to said at least one perforation which is located near the base end, and said spaced apart perforations being opened successively as a result of combustion of said smoking material and said ignition element.

26. A cigarette wrapper for a cigarette having reduced sidestream smoke between puffs, comprising:

a first layer of material formed around smoking material; and a second layer of material formed around said first layer, wherein said second layer reduces combustion of said smoking material between puffs and includes thermally opened perforations, said perforations being blocked by occlusions which block flow of oxygen through said perforations until sufficient thermal energy by combustion of said smoking material opens said perforations, wherein said first layer is more combustible than said second layer when exposed to the thermal energy generated by said smoking material, and said second layer includes a composite layer containing multiple layers.

27. The cigarette wrapper of claim 26, wherein said composite layer includes a metal foil layer.

28. The cigarette wrapper of claim 27, wherein said composite layer includes a paper layer laminated to said metal foil layer.

29. The cigarette wrapper of claim 27, wherein said composite layer includes two paper layers laminated on either side of said metal foil layer.

30. The cigarette wrapper of claim 26, wherein said second layer extends to the distal end of the cigarette.

31. The cigarette wrapper of claim 26, wherein said second layer extends to within a non-zero distance L from the distal end of the cigarette.

32. The cigarette wrapper of claim 26, wherein said thermally opened perforations comprise at least one perforation of a first size and at least one perforation of a second size which is larger than said first size.

33. The cigarette wrapper of claim 32, wherein said at least one thermally opened perforation of said first size is located closer to the distal end of the cigarette than said at least one perforation of said second size.

34. The cigarette wrapper of claim 26, wherein said thermally opened perforations are occluded by said first layer of material before smoking of the cigarette.

35. The cigarette wrapper of claim 34, wherein at least portions of said first layer of material located beneath said thermally opened perforations are sufficiently combustible when exposed to heat such that the portions are burned away during smoking of the cigarette.

36. A smoking article having reduced sidestream smoke between puffs, comprising:

a smoking material;

a first layer of material formed around said smoking material; and a second layer of material formed around said first layer, wherein said second layer reduces combustion of said smoking material between puffs and includes thermally opened perforations, said perforations being blocked by occlusions which block flow of oxygen through said perforations until sufficient thermal energy by combustion of said smoking material opens said perforations, wherein said first layer is more combustible than said second layer when exposed to thermal energy generated by said smoking material.

37. The smoking article of claim 36, wherein said smoking material includes a tobacco-based material.

38. The smoking article of claim 36,wherein the smoking article includes an ignition element within said smoking material, said smoking material being more readily extinguishable in a low oxygen environment compared to said ignition element and said ignition element is comprised of a carbon-based material.

39. The smoking article of claim 38, wherein said ignition element has a substantially cylindrical shape, and is concentrically aligned with the longitudinal axis of said smoking article.

40. The smoking article of claim 36, wherein said second layer comprises a composite layer containing multiple layers.

41. The smoking article of claim 40, wherein said composite layer includes a metal foil layer.

42. The smoking article of claim 41, wherein said composite layer includes a paper layer laminated to said metal foil layer.

43. The smoking article of claim 42, wherein said composite layer includes two paper layers laminated on either side of said metal foil layer.

44. The smoking article of claim 36, wherein said second layer extends to the distal end of said article at which said smoking material is exposed.

45. The smoking article of claim 36, wherein said second layer extends to within a non-zero distance L from the distal end of said article at which said smoking material is exposed.

46. The smoking article of claim 45, wherein said second layer extends to within approximately 1 mm to 5 mm from said end.

47. The smoking article of claim 36 wherein said thermally opened perforations comprise at least one perforation of a first size and at least one perforation of a second size which is larger than said first size.

48. The smoking article of claim 47, wherein said at least one perforation of said first size is located closer to the distal end of said smoking article than said at least one perforation of said second size.

49. The smoking article of claim 36, wherein said at least one perforation is blocked by said first layer of material before use of said article.

50. The smoking article of claim 48, wherein at least portions of said first layer of material located beneath said perforations are sufficiently combustible when exposed to heat generated by said smoking material such that the portions are burned away during use of said article.

51. The smoking article of claim 36, said perforations in said second layer comprise a plurality of perforations arranged in a pattern.

52. A smoking article having reduced sidestream smoke between puffs, comprising:

a smoking material; and a wrapper formed around said smoking material, wherein said wrapper reduces combustion of said smoking material between puffs, wherein said wrapper includes at least one perforation having an opening blocked by an occlusion, said at least one perforation being blocked by the occlusion which blocks flow of oxygen through said at least one perforation until sufficient thermal energy by combustion of said smoking material opens said at least one perforation.

53. The smoking article of claim 52, wherein said occlusion comprises a first layer of material disposed beneath or above said wrapper.

54. The smoking article of claim 52, wherein said occlusion comprises a combustible filling material which blocks said opening.

55. The smoking article of claim 52, wherein said at least one perforation comprises a plurality of perforations.

56. The smoking article of claim 55, wherein said plurality of perforations comprises a first plurality of perforations having openings having a first dimension and a second plurality of perforations having openings having a second dimension, wherein said openings with said first dimension are smaller than said openings with said second dimension.

57. The smoking article of claim 56, wherein said first plurality of perforations are located closer to an open distal end of said cigarette compared to said second plurality of perforations.

58. The smoking article of claim 52, wherein said smoking material is disposed in a smoking material section of said smoking article having a base end and an open distal end, and said at least one perforation is located near said base end.

59. The smoking article of claim 58, further comprising additional perforations located closer to the open distal end compared to said at least one perforation which is located near the base end, wherein said additional perforations have smaller sizes compared to said at least perforation which is located near the base end.

60. The smoking article of claim 52, wherein the smoking article includes an ignition element within said smoking material, said smoking material being more readily extinguishable in a low oxygen environment compared to said ignition element.

* * * * *